US010968612B1

(12) United States Patent
Tzeng

(10) Patent No.: US 10,968,612 B1
(45) Date of Patent: Apr. 6, 2021

(54) DOUBLE SHOWER DEVICE

(71) Applicant: NCIP INC., Taipei (TW)

(72) Inventor: Rong-Chyan Tzeng, Taipei (TW)

(73) Assignee: NCIP Inc., Taipei (TW)

( * ) Notice: Subject to any disclaimer, the term of this patent is extended or adjusted under 35 U.S.C. 154(b) by 0 days.

(21) Appl. No.: 16/717,328

(22) Filed: Dec. 17, 2019

(51) Int. Cl.
*E03C 1/02* (2006.01)

(52) U.S. Cl.
CPC ..... *E03C 1/023* (2013.01)

(58) Field of Classification Search
CPC ..... E03C 1/023
USPC ..... 4/601
See application file for complete search history.

(56) References Cited

U.S. PATENT DOCUMENTS

| | | | | |
|---|---|---|---|---|
| 9,410,309 | B2 | 8/2016 | Sharratt et al. | |
| 9,506,230 | B2 | 11/2016 | Schulte | |
| 9,677,256 | B2 | 6/2017 | Wilson | |
| 10,561,281 | B1 * | 2/2020 | Lu | E03C 1/023 |

* cited by examiner

*Primary Examiner* — Tuan N Nguyen
(74) *Attorney, Agent, or Firm* — Muncy, Geissler, Olds & Lowe, P.C.

(57) ABSTRACT

A double shower device comprises a water inlet pipe, a first water separator, a first shower bar, a second shower bar, and a second water separator. The first water separator comprises a first water inlet end connected to the water inlet pipe, a first chamber connected to the first water inlet end, and a block member disposed in the first chamber to be moved vertically. The second water separator is connected to one end of the second shower bar opposite to the first water separator, and comprises a second water inlet end connected to the second shower bar, a second chamber connected to the second water inlet end, and a valve member disposed in the second chamber. The valve member comprises an open state and a close state for moving the block member downward and upward respectively to force a water flow to flow downward and upward respectively.

5 Claims, 9 Drawing Sheets

DOUBLE SHOWER DEVICE

FIELD OF THE INVENTION

The present invention relates to a shower device, and more particularly to a double shower device which is not controlled by the source direction of water flow.

BACKGROUND OF THE INVENTION

Bathing and shower can wash away a whole day of worry and tiredness, and people would be revitalized with refreshment and energy. Therefore, appliances or devices of bathing and shower have potential markets. Moreover, as the price of land is increasingly high, shower devices that are less space-consuming become more popular among the users.

Related manufacturers have focused on the business opportunities by introducing various different shower devices. Nowadays, shower bars with the water inlet located at the lower end are commonly used in the shower devices, but the shower bars are only suitable for the shower faucets mounted on the wall or the shower panels with the water inlet located at the lower end. When water can only discharged from the wall-mounted shower faucets with the water inlet located at the upper end, it is generally required to alter the pipes that are embedded into the wall if people want to transform the function from a single shower to a double shower for discharging water, which requires long construction time and causes environmental pollution.

In order to solve the aforementioned problem that the water inlet end can only be disposed at a low position, the prior art, for example, U.S. Pat. No. 9,506,230 B2, which relates to a wall-mounted shower system comprising at least one bracket and connected to at least one conduit and at least one adapting piece. In addition, the bracket is designed to accommodate an adapting piece and provide a sealing component between the bracket and the adapting piece. The sealing component allows relative movement between the bracket and the adapting piece. The adapting piece is further connected to a wall by a first connecting component, and the bracket is connected to the wall by a second connecting component. The bracket and the adapting piece form at least one conduit path between the wall connection and the conduit of the shower system during assembling. However, the conventional technique is a tube-in-tube structure, and the so-called tube-in-tube structure is relatively complicated, so that the processing precision is high, thereby the cost is increased. Moreover, the conventional shower system is assembled in a fixed manner, that is, the shower bar fails to be retractably adjusted, which may cause inconvenience in usage. Other prior arts with similar concept are mentioned in U.S. Pat. No. 9,677,256 B2, and U.S. Pat. No. 9,410,309 B2, which are not described herein since the technical contents mentioned by these conventional techniques are similar.

As mentioned above, even though the prior arts have barely overcome the dilemma that the water inlet end is only disposed at a low position, the complicated structures and high cost are still required to be improved. Therefore, there is still great room for improvement in the existing shower devices, and it is necessary to provide a shower device which is simple in structure, low in cost, and can overcome the problem that the water inlet end is only disposed at a low position.

SUMMARY OF THE INVENTION

An object of the present invention is to solve the problem that the water inlet end is only disposed at a low position which cannot be overcome by the conventional techniques.

Another object of the present invention is to solve the problem of complicated structures and high cost of the conventional techniques.

In order to achieve the above objects, the present invention provides a double shower device comprising a water inlet pipe, a first water separator, a first shower bar, a second shower bar, and a second water separator. The water inlet pipe is provided for a water flow to flow in. The first water separator comprises a first water inlet end connected to the water inlet pipe, a first chamber connected to the first water inlet end, a block member disposed in the first chamber to move vertically, and an upper water outlet end and a first lower water outlet end which are connected to the first chamber. The block member includes a lower sealing element sealing the first lower water outlet end when the block member is moving upward, and an upper sealing element sealing the upper water outlet end when the block member is moving downward.

The first shower bar comprises a first passage connected to the upper water outlet end of the first water separator, wherein the first water inlet end, the first chamber, the upper water outlet end and the first passage together form an upper water outlet channel. The second shower bar is disposed under the water inlet pipe, the first water separator and the first shower bar, and the second shower bar comprises a second passage extending downward to connect with the first lower water outlet end of the first water separator and extends downward.

The second water separator is connected to one end of the second shower bar opposite to the first water separator, and the second water separator comprises a second water inlet end connected to the second shower bar, a second chamber connected to the second water inlet end, a valve member disposed in the second chamber, and a second lower water outlet end connected to the second chamber, wherein the first water inlet end, the first chamber, the first lower water outlet end, the second passage, the second water inlet end, the second chamber and the second lower water outlet end together form a lower water outlet channel. Moreover, the valve member comprises an open state for moving the block member downward to force the water flow to flow along the lower water outlet channel, and a close state for moving the block member upward to force the water flow to flow along the upper water outlet channel.

Accordingly, the present invention is disposed with the first water separator and the second water separator, and pushes the block member to move by water pressure, so that the block member moves upward or downward, thereby the water flow direction is controlled. Therefore, when a water source comes from a higher position, a user can directly install and use without changing the existing setting. In addition, the present invention mainly adopts a structure that is not a tube-in-tube structure, which can greatly reduce manufacturing difficulty and material costs, and reduce a quantity of assembly parts and tolerances.

DETAILED DESCRIPTION OF THE PREFERRED EMBODIMENTS

The detailed description and technical content of the present invention are described with reference to the accompanying drawings as follows.

Figure 1:
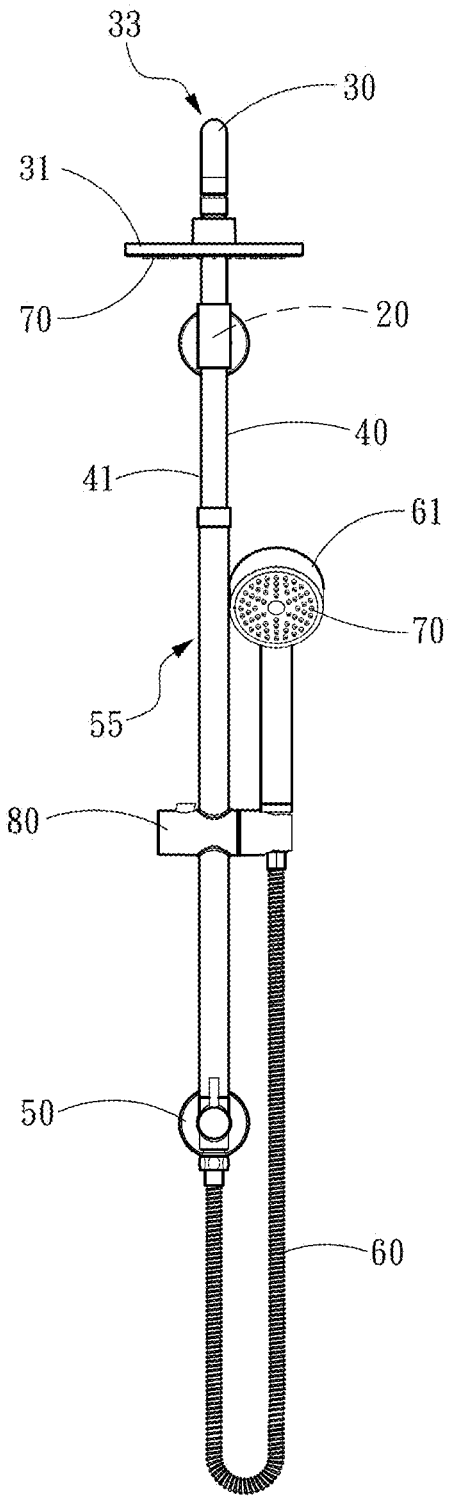
FIG. 1 is a plan view of an embodiment of the present invention.
Figure 2A:
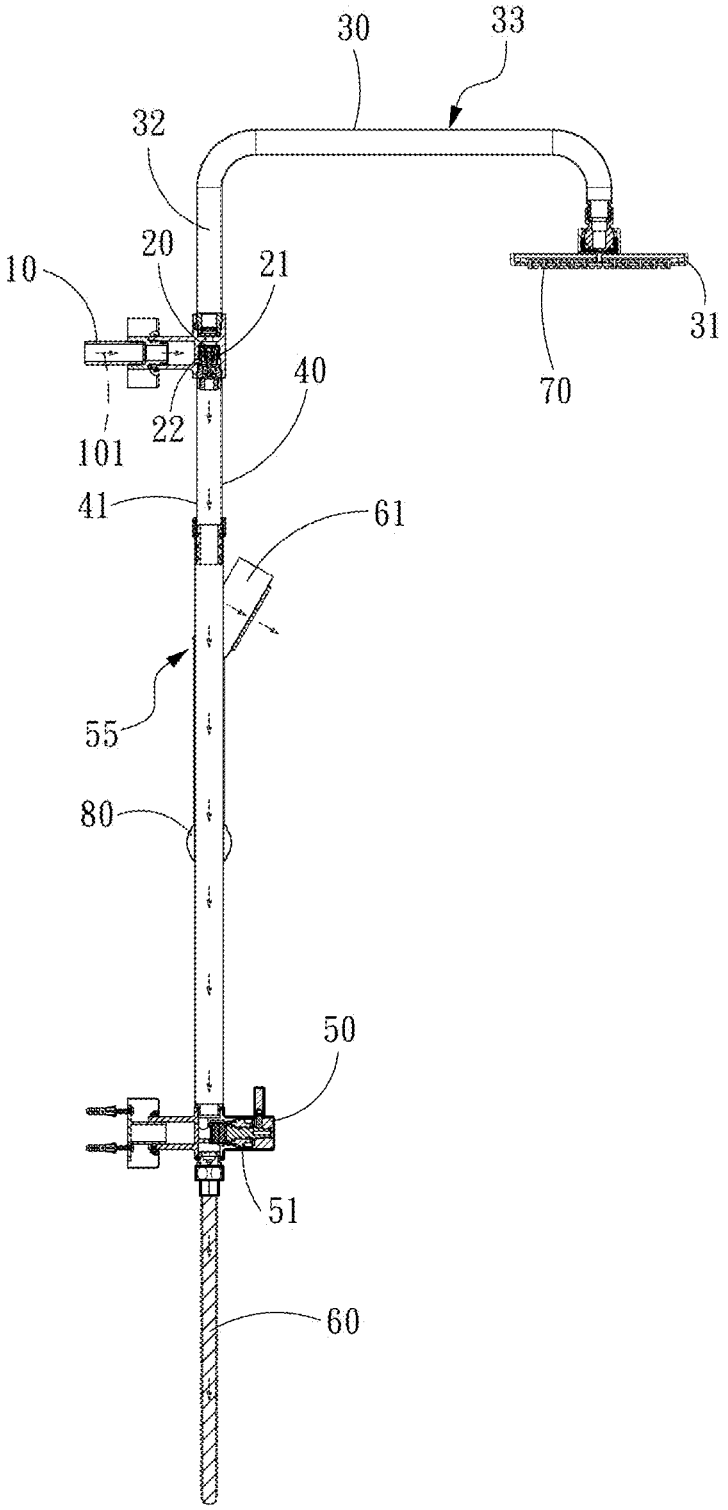
FIG. 2A is a partial cross-sectional view of an embodiment of the present invention.
Figure 2B:
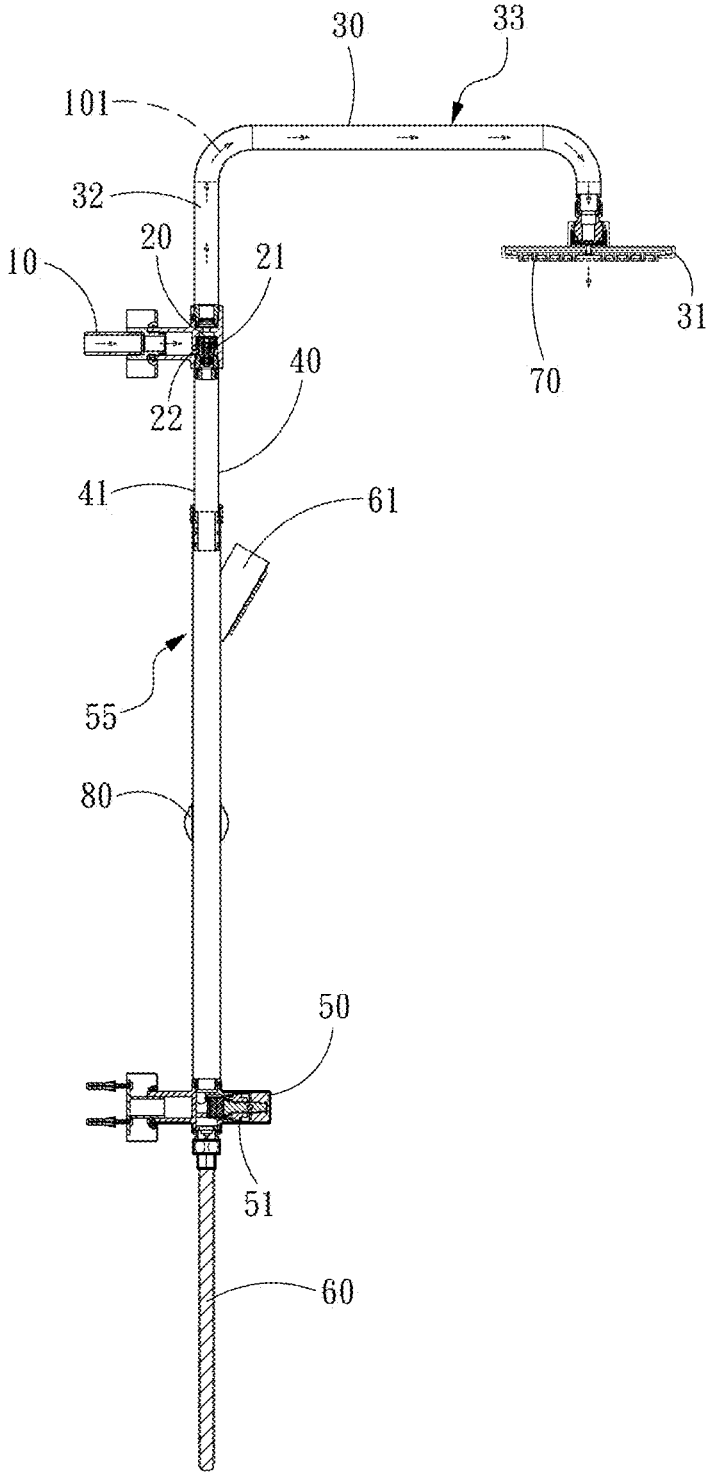
FIG. 2B is another partial cross-sectional view of an embodiment of the present invention.

Please refer to FIG. 1, FIG. 2A and FIG. 2B. The present invention provides a double shower device comprising a water inlet pipe 10, a first water separator 20, a first shower bar 30, a second shower bar 40, and a second water separator 50. In one embodiment, the double shower device further comprises a flexible water outlet pipe 60.

Figure 3A:
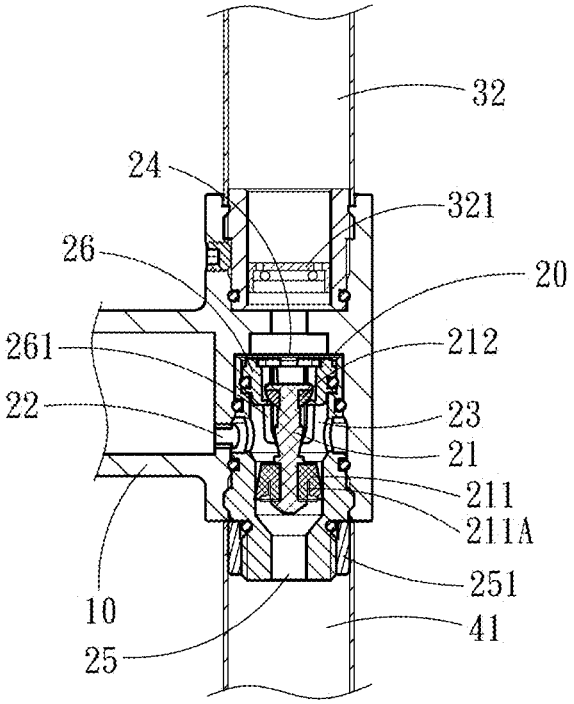
FIG. 3A is a partial enlarged cross-sectional view of a first water separator according to an embodiment of the present invention.
Figure 3B:
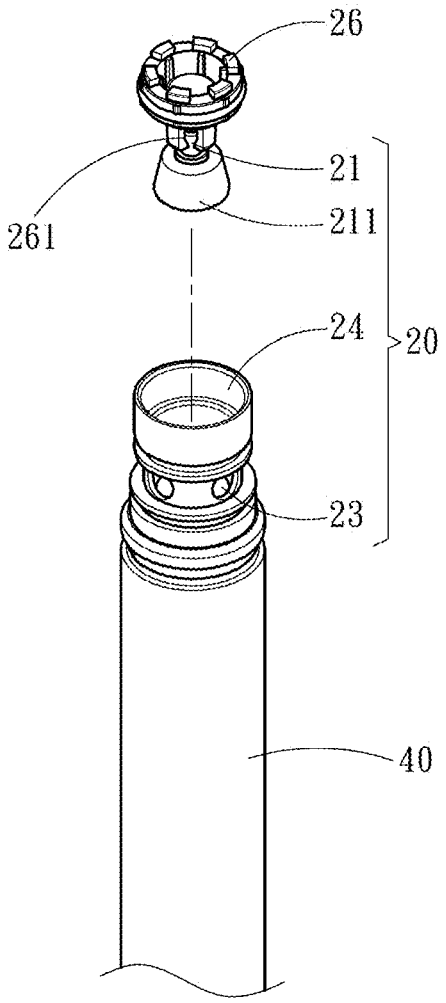
FIG. 3B is a perspective partial exploded view of the first water separator according to an embodiment of the present invention.

Please refer to FIG. 2B, FIG. 3A and FIG. 3B. The water inlet pipe 10 is provided for a water flow 101 to flow into and guides the water flow 101 into the first water separator 20 connected to the water inlet pipe 10, wherein the water inlet pipe 10 and the first water separator 20 are connected by a first water inlet end 22 of the first water separator 20. The first water separator 20 comprises a first chamber 23 connected to the first water inlet end 22, and a block member 21 is disposed in the first chamber 23 to be moved vertically. The first water separator 20 comprises an upper water outlet end 24 and a first lower water outlet end 25 which are connected to the first chamber 23. The block member 21 is sleeved on a fixing seat 26, which is disposed in the upper water outlet end 24 and the first chamber 23. The fixing seat 26 comprises an opening 261 communicating with the first chamber 23. In one embodiment, the block member 21 is provided with a lower sealing element 211 and an upper sealing element 212. When the block member 21 moves upward, the lower sealing element 211 is pushed to seal the first lower water outlet end 25; and when the block member 21 moves downward, the upper sealing element 212 is pushed to seal the upper water outlet end 24.

Figure 5:
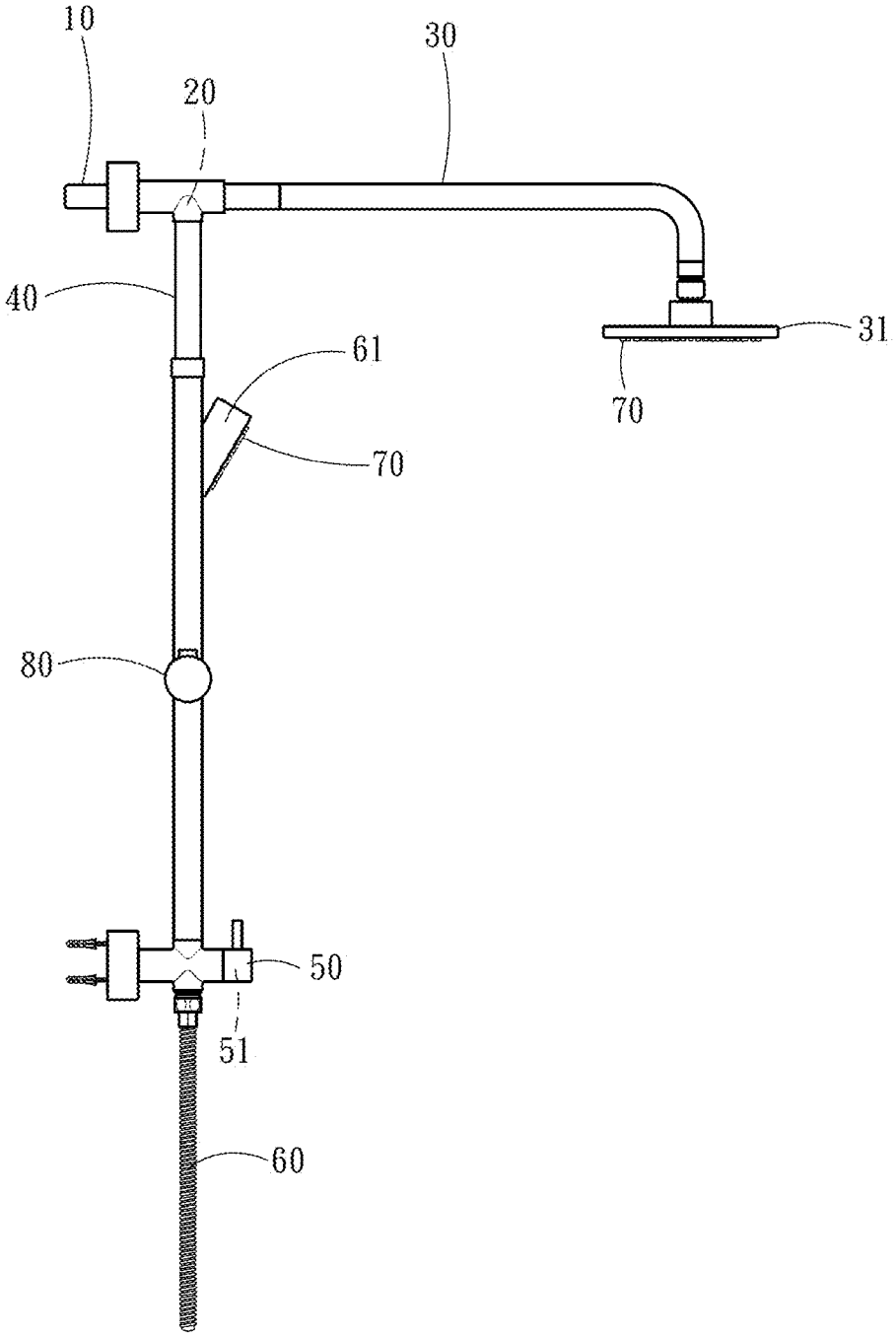
FIG. 5 is a side view of the appearance of another embodiment of the present invention.
Figure 6:
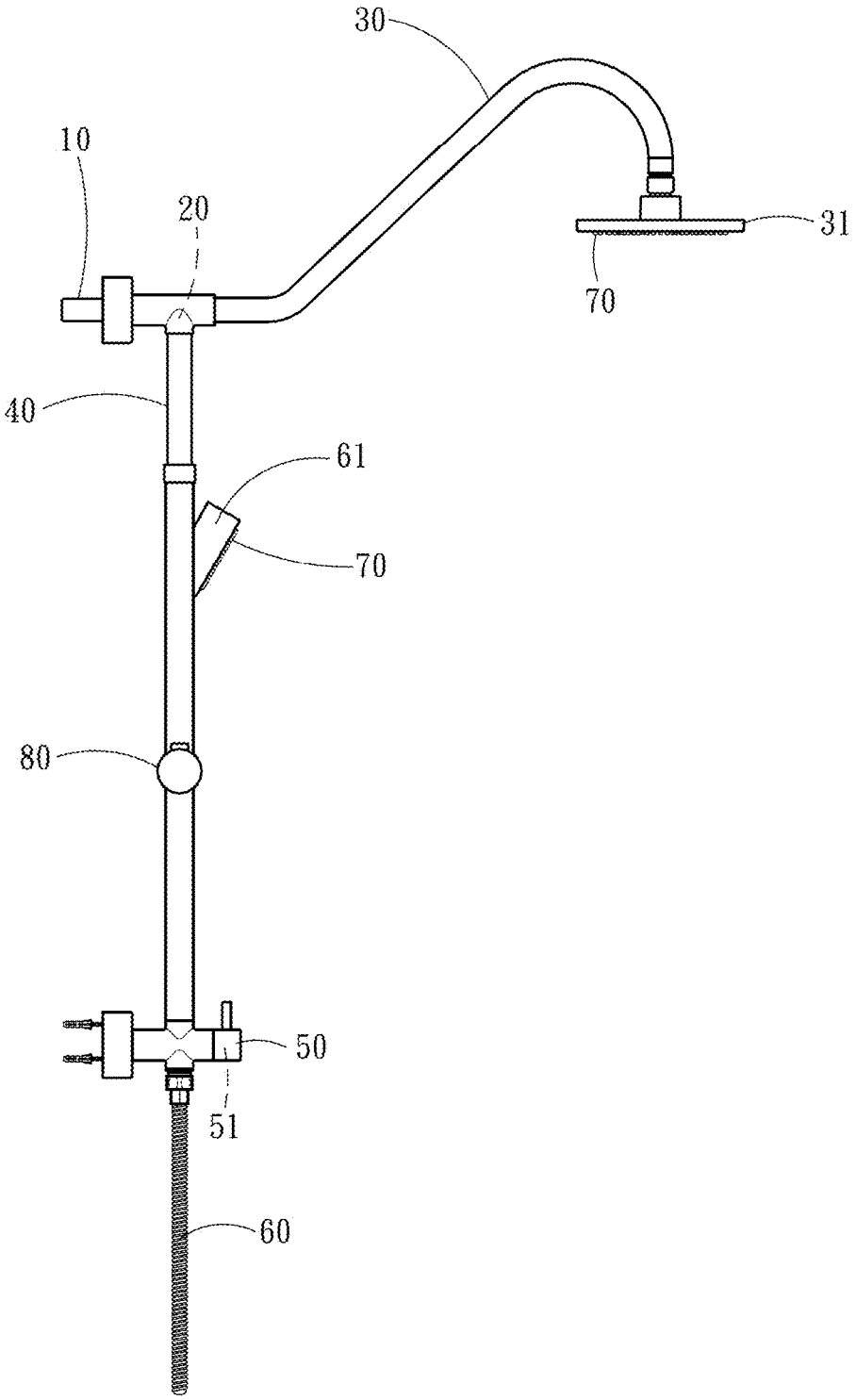
FIG. 6 is a side view of the appearance of another embodiment of the present invention.

The first shower bar 30 comprises a first passage 32 connected to the upper water outlet end 24 of the first water separator 20, whereby just one first shower bar 30 is connected with the first water separator 20. That is, it is not a tube-in-tube structure. The first water inlet end 22, the first chamber 23, the upper water outlet end 24 and the first passage 32 form an upper water outlet channel 33. Besides, the first passage 32 further includes a top spray shower head 31 at one end opposite to the upper water outlet end 24, wherein the size and shape of a plurality of holes 70 in the top spray shower head 31 are adjusted according to the needs of those skilled in the art. In one embodiment, as shown in FIG. 1, FIG. 2A, and FIG. 2B, the exterior shape of the first shower bar 30 is an L-shape In one embodiment, as shown in FIG. 5 and FIG. 6 separately, the exterior shape of the first shower bar 30 is a crossbar shape or a hook shape. Further, the function of the present invention is not affected even the shape of the first shower bar 30 changed, and thus a person skilled in the art can adopt the first shower bar 30 with different shape.

The second shower bar 40 is disposed below the water inlet pipe 10, the first water separator 20, and the first shower bar 30. The second shower bar 40 comprises a second passage 41 connected to the first lower water outlet end 25 of the first water separator 20 and extending downward, whereby just one second shower bar 40 is connected with the first water separator 20. That is, it is not a tube-in-tube structure. Furthermore, the second shower bar 40 is a telescopic rod with sealing property, and the second shower bar 40 is extended or shortened according to the requirement of usage. The first lower water outlet end 25 is provided with a pipe plug 251, and the pipe plug 251 is welded and fixed to the second shower bar 40.

Figure 3C:
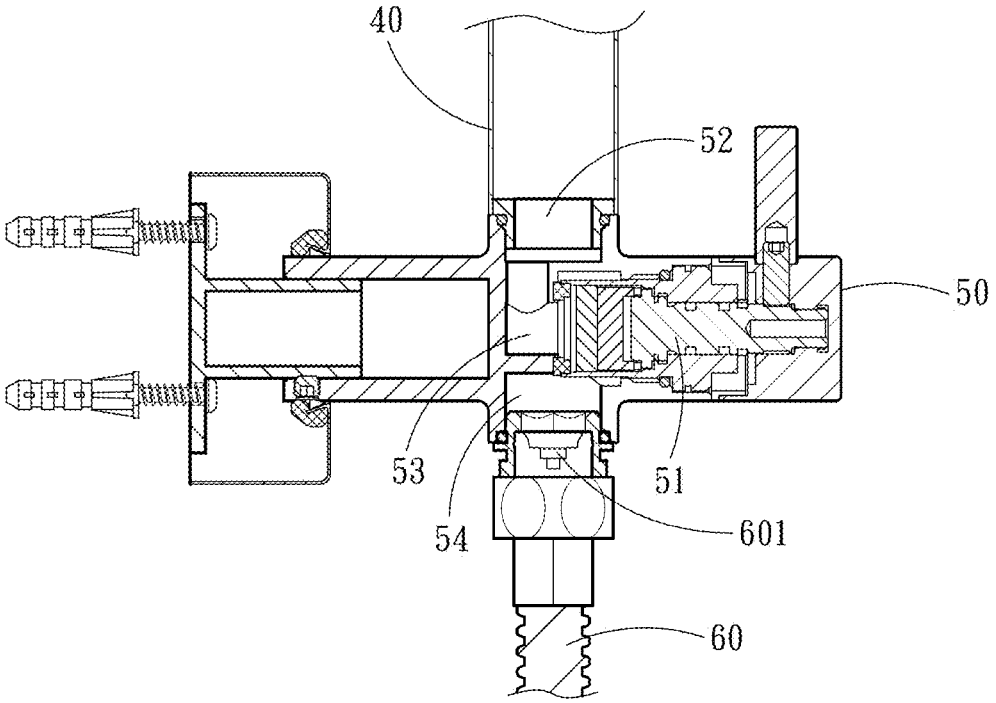
FIG. 3C is a partial enlarged cross-sectional view of a second water separator according to an embodiment of the present invention.
Figure 4A:
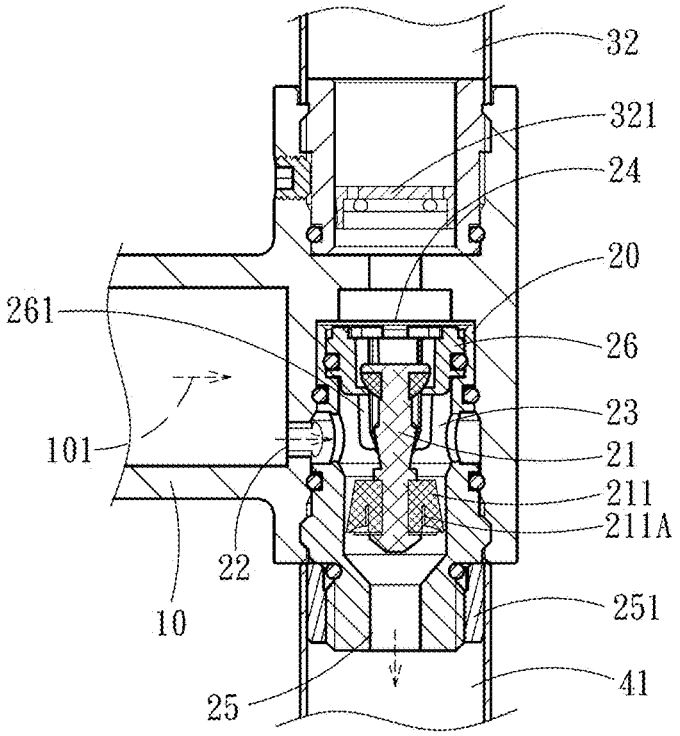
FIG. 4A is a schematic view of flow direction of a water flow in the first water separator according to an embodiment of the present invention.
Figure 4B:
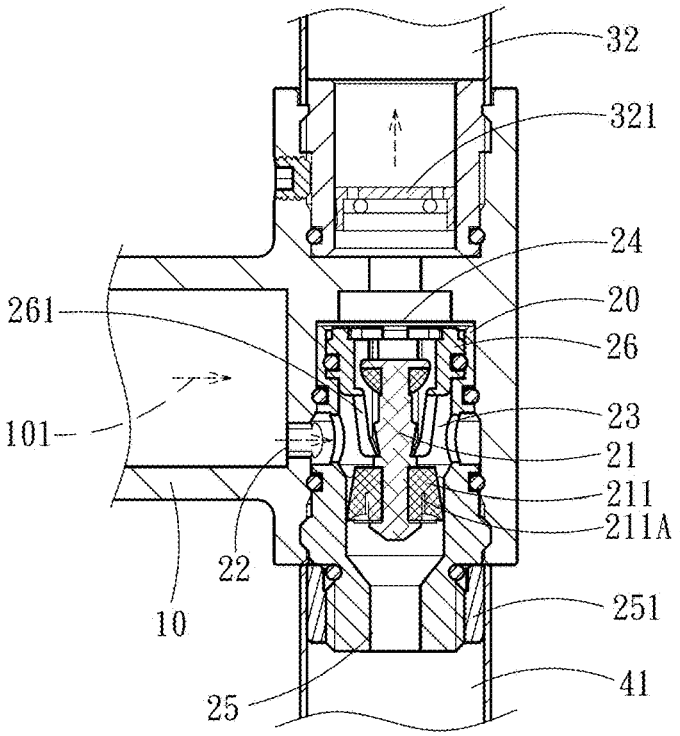
FIG. 4B is a schematic view of another flow direction of the water flow in the first water separator according to an embodiment of the present invention.

Please refer to FIG. 2A, FIG. 3C, FIG. 4A, and FIG. 4B. The second water separator 50 is connected to one end of the second shower bar 40 opposite to the first water separator 20. The second water separator 50 includes a second water inlet end 52, a second chamber 53 and a second lower water outlet end 54. The second chamber 53 is connected to the second water inlet end 52, and the second lower water outlet end 54 is connected to the second chamber 53. Further, a lower water outlet channel 55 is formed by the first water inlet end 22, the first chamber 23, the first lower water outlet end 25, the second passage 41, the second water inlet end 52, the second chamber 53 and the second lower water outlet end 54. Moreover, the second chamber 53 is provided with a valve member 51, and the valve member 51 comprises an open state and a close state. As shown in FIG. 4A, in the open state, the block member 21 is moved downward to force the water flow 101 to flow along the lower water outlet channel 55. As shown in FIG. 4B, in a close state, the block member 21 is moved upward to force the water flow 101 to flow along the upper water outlet channel 33.

Please refer to FIG. 1, FIG. 2A, and FIG. 3C, the flexible water outlet pipe 60 is connected with one end of the second lower water outlet end 54 opposite to the second water inlet end 52. Further, the word "flexible" means it is able to be freely bent. A handheld shower head 61 is disposed at one end of the flexible water outlet pipe 60 opposite to the second lower water outlet end 54. Similar to the top spray shower head 31 provided with the plurality of holes 70, the handheld shower head 61 is also provided with the plurality of holes 70 for the water flow 101 to flow out. Besides, the size and shape of the plurality of holes 70 in the top spray shower head 31 is adjusted according to the needs of a person skilled in the art. Please refer to FIG. 3A and FIG. 3C, in one embodiment, a clamping device 80 is disposed on the second shower bar 40 for clamping the handheld shower head 61. The flexible water outlet pipe 60 is disposed with a second limiter 601 which is funnel-shaped at a position near the second lower water outlet end 54. In addition to reducing the water flow rate, the second limiter 601 provides a backflow prevention effect due to the funnel-shaped of the second limiter 601, such that a backflow of polluted water occurred by the siphon effect is avoided when the handheld shower head 61 is dropped into water. Furthermore, when a pressure of the water flow 101 of the water inlet pipe 10 is relatively large, the water flow 101 will generate noise when entering into the first passage 32 intermittently. Therefore, the first passage 32 is disposed with a first limiter 321 at a position adjacent to the upper water outlet end 24, and water pressure at both ends is balanced by the first limiter 321 and the second limiter 601. Thus, noise causing by the first water separator 20 is avoided since the first water separator 20 does not cause irregular vibrations due to uneven pressure.

The operation mode of the present invention is further described in conjunction with FIG. 2A, FIG. 2B, FIG. 4A, and FIG. 4B.

Please refer to FIG. 2A and FIG. 4A. When the valve member 51 is controlled by a user to be in the open state, the block member 21 tends to move downward due to the pressure difference. Therefore, the water flow 101 is forced to flow downward along the direction of the lower water outlet channel 55 to discharge water. The water pressure drives the block member 21 to move downward, causing the upper sealing element 212 to seal the upper water outlet end 24, and pressing a gap 211A of the lower sealing element 211 to deform, and then to open the flowing passage that allows the water flow 101 to flow downward. Therefore, the water flow 101 is forced to flow along the lower water outlet channel 55 and toward the flexible water outlet pipe 60, and finally flow out from the handheld shower head 61.

Please refer to FIG. 2B and FIG. 4B. When the valve member 51 is controlled by the user to be in the close state, the lower water outlet channel 55 is closed. Therefore, the water pressure drives the block member 21 to move upward and to push the upper sealing element 212, and causing the lower sealing element 211 to seal the first lower water outlet end 25. The water flow 101 is forced to flow along the upper water outlet channel 33 and toward the first shower bar 30 to discharge water from the top spray shower head 31, only after entering the opening 261 through the first chamber 23.

Accordingly, the present invention comprises the first water separator and the second water separator, and the block member is driven by water pressure to move upward or downward, thereby controlling the direction of the water flow. Therefore, when a water source comes from a higher position, the user can directly install and use without changing the existing setting. Moreover, since the present invention is disposed with the top spray shower head and the handheld shower head, with the adjustment of the position of the valve member, the top spray shower and the handheld shower is switched for using to achieve double valve control. In addition, the present invention mainly adopts a structure that is not a tube-in-tube structure, which can greatly reduce manufacturing difficulty and material costs, and reduce a quantity of assembly parts and tolerances.

What is claimed is:

1. A double shower device, comprising:

a water inlet pipe provided for a water flow to flow in;

a first water separator comprising a first water inlet end connected to the water inlet pipe, a first chamber connected to the first water inlet end, a block member disposed in the first chamber to move vertically, and an upper water outlet end and a first lower water outlet end which are connected to the first chamber, wherein the block member includes a lower sealing element sealing the first lower water outlet end when the block member moving upward, and an upper sealing element sealing the upper water outlet end when the block member moving downward;

a first shower bar comprising a first passage connected to the upper water outlet end of the first water separator, wherein the first water inlet end, the first chamber, the upper water outlet end and the first passage together form an upper water outlet channel;

a second shower bar disposed under the water inlet pipe, the first water separator and the first shower bar, and the second shower bar comprising a second passage extending downward to connect with the first lower water outlet end of the first water separator; and a second water separator connected to one end of the second shower bar opposite to the first water separator, and the second water separator comprising a second water inlet end connected to the second shower bar, a second chamber connected to the second water inlet end, a valve member disposed in the second chamber, and a second lower water outlet end connected to the second chamber, wherein the first water inlet end, the first chamber, the first lower water outlet end, the second passage, the second water inlet end, the second chamber and the second lower water outlet end together form a lower water outlet channel; wherein the valve member comprises an open state for moving the block member downward to force the water flow to flow along the lower water outlet channel, and a close state for moving the block member upward to force the water flow to flow along the upper water outlet channel.

2. The double shower device as claimed in claim 1, wherein one end of the first passage opposite to the upper water outlet end further comprises a top spray shower head.

3. The double shower device as claimed in claim 1, wherein the first passage is disposed with a first limiter at a position adjacent to the upper water outlet end.

4. The double shower device as claimed in claim 1, wherein one end of the second lower water outlet end opposite to the second water inlet end further comprises a flexible water outlet pipe with a handheld shower head.

5. The double shower device as claimed in claim 4, wherein the flexible water outlet pipe is disposed with a second limiter which is funnel-shaped at a position near the second lower water outlet end.

* * * * *